US006082429A

United States Patent [19]

Ochoa

[11] Patent Number: 6,082,429

[45] Date of Patent: Jul. 4, 2000

[54] STIFFENERS FOR SECTIONAL OVERHEAD DOORS

[76] Inventor: Carlos M. Ochoa, 1301 Barthelow, Suite 4A, College Station, Tex. 77840-4539

[21] Appl. No.: 09/263,684

[22] Filed: Mar. 5, 1999

Related U.S. Application Data

[63] Continuation-in-part of application No. 09/116,689, Jul. 16, 1998, which is a continuation-in-part of application No. 08/787,472, Jan. 22, 1997, abandoned.

[51] Int. Cl.[7] ..... E05D 15/06

[52] U.S. Cl. ..... 160/201; 160/209

[58] Field of Search ..... 160/201, 209; 52/291, 720.1

[56] References Cited

U.S. PATENT DOCUMENTS

| | | |
|---|---|---|
| 1,261,735 | 4/1918 | Hunker . |
| 1,555,895 | 10/1925 | Weber . |
| 1,759,457 | 5/1930 | Kamin . |
| 2,007,688 | 7/1935 | McCloud . |
| 2,015,402 | 9/1935 | Johanson . |
| 2,091,299 | 8/1937 | Bagley et al. . |
| 2,207,381 | 7/1940 | Lang . |
| 2,251,967 | 8/1941 | Yoder . |
| 2,271,309 | 1/1942 | Rowe . |
| 2,287,372 | 6/1942 | Blodgett . |
| 2,534,641 | 12/1950 | Veigel . |
| 2,575,255 | 11/1951 | Blodgett . |
| 2,686,926 | 8/1954 | Schacht, Jr. et al. . |
| 2,702,082 | 2/1955 | Wolf . |
| 2,755,081 | 7/1956 | Johnson et al. . |
| 2,831,537 | 4/1958 | Ritter . |
| 2,880,796 | 4/1959 | Stroup . |
| 2,925,267 | 2/1960 | Volf . |
| 2,991,496 | 7/1961 | Wolf et al. . |
| 3,034,575 | 5/1962 | Stroup . |
| 3,090,427 | 5/1963 | Stroup . |
| 3,136,357 | 6/1964 | Lorentzen et al. . |
| 3,140,508 | 7/1964 | Switzgable . |
| 3,202,415 | 8/1965 | Lodge . |
| 3,227,205 | 1/1966 | Crosswell . |
| 3,484,812 | 12/1969 | Holland . |
| 3,511,301 | 5/1970 | Graham et al. . |
| 3,552,474 | 1/1971 | Finnegan . |
| 3,555,750 | 1/1971 | Banse . |
| 3,608,613 | 9/1971 | Halliwell . |
| 3,797,171 | 3/1974 | Farmer . |
| 4,016,920 | 4/1977 | Shepard . |
| 4,119,133 | 10/1978 | Wolf . |
| 4,120,072 | 10/1978 | Hormann . |
| 4,205,713 | 6/1980 | Galbreath . |
| 4,511,173 | 4/1985 | Wentzel . |
| 4,532,973 | 8/1985 | DeFalco . |
| 4,625,456 | 12/1986 | LaFontaine . |
| 4,732,203 | 3/1988 | Alten . |
| 4,934,439 | 6/1990 | Martin ..... 160/201 |
| 4,966,217 | 10/1990 | DeChambeau et al. . |
| 5,036,899 | 8/1991 | Mullet . |

(List continued on next page.)

FOREIGN PATENT DOCUMENTS

| | | |
|---|---|---|
| 551659 B | 4/1923 | France . |
| 881334 A | 6/1953 | Germany . |
| 90953 | 3/1955 | Norway . |
| 1263386 | 10/1986 | U.S.S.R. . |
| 1349828 | 11/1987 | U.S.S.R. . |
| 1755995 | 8/1992 | U.S.S.R. . |

*Primary Examiner*—Blair M. Johnson
*Attorney, Agent, or Firm*—Browning Bushman

[57] ABSTRACT

An overhead sectional garage door (10) has a plurality of hinged sections or panels (14) having rollers (16) mounted thereon for movement of the door (10) between open and closed positions. A stiffener (39) is secured to each door section (14) and extends horizontally between opposed sides of the associated door section (14). Each stiffener (39) has a horizontal body (38), an inner vertical mounting flange (41), and an outer bowed flange (42). Vertical mounting flange (41) and bowed flange (42) have free edges and respective inturned beads or curls (44, 46) are formed thereon for stiffening of flanges (41) and (42).

17 Claims, 3 Drawing Sheets

U.S. PATENT DOCUMENTS 5,172,744 12/1992 Finch et al. .
5,240,216 8/1993 Lin et al. .
5,408,724 4/1995 Mullet et al. .
5,409,051 4/1995 Mullet et al. .
5,630,459 5/1997 Martin .
5,706,877 1/1998 Grisham et al. ..... 160/201
5,749,407 5/1998 Brenner et al. ..... 160/201

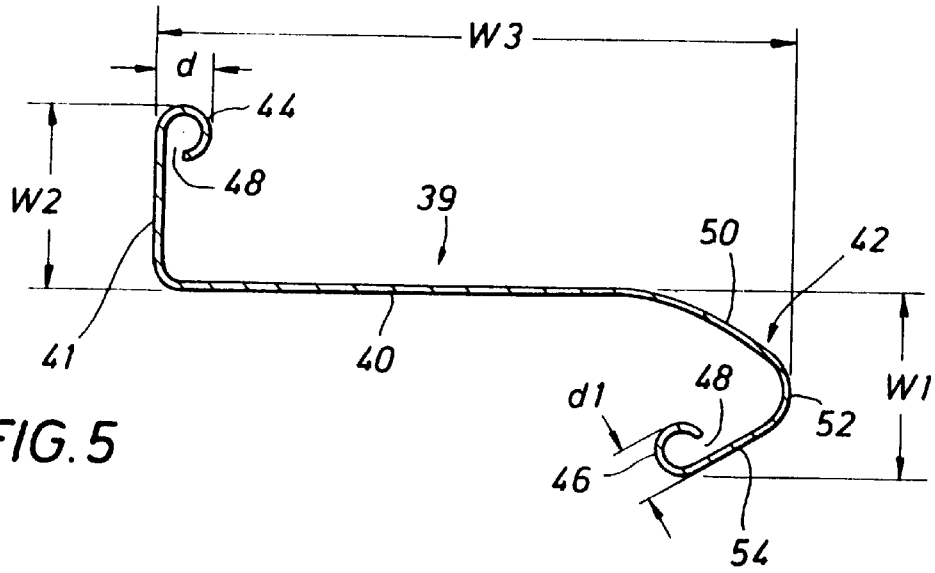
FIG. 5
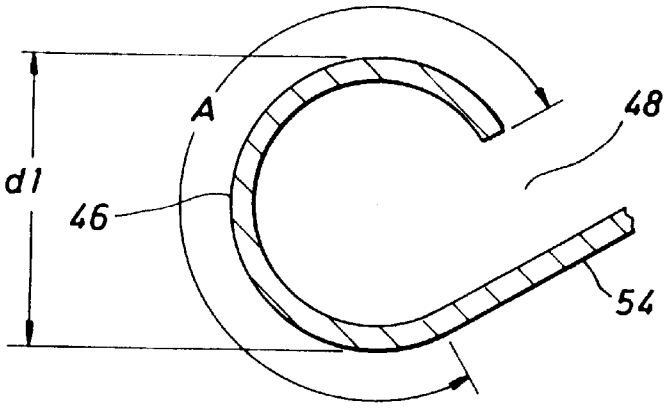
FIG. 6
FIG. 7
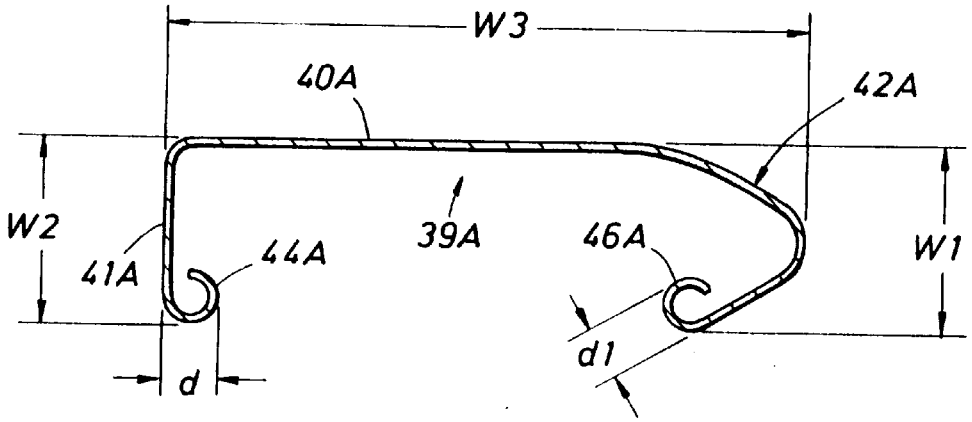

STIFFENERS FOR SECTIONAL OVERHEAD DOORS

REFERENCE TO RELATED APPLICATIONS

This application is a continuation-in-part of application Ser. No. 09/116,689 filed Jul. 16, 1998; which is a continuation-in-part of application Ser. No. 08/787,472 filed Jan. 22, 1997, now abandoned.

FIELD OF THE INVENTION

This invention relates generally to a reinforcing support structure for a hinged sectional overhead door, and more particularly to horizontally extending metal stiffeners mounted on the inside of the door sections.

BACKGROUND OF THE INVENTION

Over the past several years local building codes throughout the country have increasingly required commercial and residential overhead garage door installations to be able to sustain higher and higher wind loads. This has been especially true for those counties in South Florida such as Dade County as well as other coastal regions where the threat of hurricane force wind is always a factor in determining structural safety. Generally speaking a garage door's ability to sustain wind load is directly related to the type and strength of the stiffener typically installed on the inside of the door. The current approach within the industry to meet these higher requirements has ranged from increasing the thickness of conventional stiffeners, to increasing the depth of the conventional stiffener designs as well as yield strength of the material used in making the stiffeners. In order to appreciate the uniqueness and novelty of the current invention, a better understanding of the current state of the art in addressing the above building requirements follows.

The first and most common approach taken by the industry in addressing the higher requirements has been to make the conventional stiffener out of heavier gauge material. Since the force that a wind exerts on a garage door generally increases with the square of the wind velocity, manufacturers using this approach have had to increase material thickness proportionally. These traditional stiffener designs include the C-channel stiffener as well as the hat-shaped stiffener. Heavier gauges such as 0.055 inch min. (17 gauge) to 0.070 inch min. (15 gauge) material are now common. The use of thicker material has not only lead to greater cost for garage door manufacturers and consumers but also as will be shown, has had the effect of creating other major problems simultaneously.

The garage door including any stiffeners is a system of parts interacting with each other as they are acted upon by wind load. Currently, residential and commercial overhead doors are typically constructed using steel skin with foam core assemblies, or using composites or wood. These are structures of marginal stiffness. These doors are typically supported by metal stiffeners to provide greater support as the door system sustains forces applied by the wind. However, an incompatibility occurs when stiffer sections i.e. stiffeners made of 0.055 inch min. to 0.070 inch min. material are joined or fastened to thinner less stiff sections i.e. steel skin doors made of 0.023 inch min. to 0.038 inch min. material. The area where these two sections are joined is an area of load transfer and thus of stress. The reason is that the stiffer section (i.e. the stiffener) resists conforming to the deformation of the less stiff section (i.e. the door) as wind load is increased. The result is that one part of the system (the door) tries to slide relative to another part of the system (the stiffener). This results in early failure caused by buckling of the door skin. This is due to in-plane compressive loads that result from the constraint that the stiffener imposes on the adjacent door skin as the door bends. Because of the increased stress at the joining area, manufacturers have been forced to modify parts of the garage door to offset this effect. For example, because the use of heavier stiffeners increases the shear load through the fasteners, especially on the outer extremes of the door width (near the rollers), heavier door panel end stiles have had to be introduced. Still another approach to alleviate the problem has been to use clips instead of threaded fasteners. This has been implemented in an attempt to reduce the high in-plane compressive stresses that the heavy stiffeners impose on the door skin. However, this approach is undesirable because by permitting sliding, it reduces the ability of the stiffener and door to act as a single system. This in turn reduces the total bending stiffness of the system and thus the effectiveness of the stiffener, since they now act more like independent components. This approach requires still heavier stiffeners, since the stiffener efficiency is greatly reduced when it acts as an independent component rather than as part of a system. Another drawback to clipping is that it requires substantially more parts and installation time. second approach generally taken by the industry is to make the current hat-shaped and C-channel stiffeners deeper and out of thinner yet higher yield strength material. This offers the advantage of reducing in-plane stress as noted above while at the same time increasing bending stiffness due to the deeper configuration. However this approach has major disadvantages.

First, the thinner material used in traditional stiffener configurations make these stiffener sections more susceptible to edge stress concentration. The conventional C-channel, and hat-shaped stiffeners have a "blade edge". This edge is very susceptible to imperfections in the sheet metal along this edge as well as to damage during manufacture, shipping/handling and installation. These imperfections along the blade edge become stress concentration points or focal points at which failure of the stiffener can initiate. A more detailed description of this failure initiation follows.

Even the most perfect, smooth edge of the conventional stiffener will experience a very localized point of high stress gradient due to the characteristic edge stress concentration associated with open sections under bending loads. Thus, initiation of an edge "bulge" or "crimp" on a perfect smooth edge is nothing more than the creation of an edge imperfection that is large enough to grow or "propagate" easily. It is significant that this stress concentration may be made worse by the presence of any relatively small local edge imperfections, even those on the order of size of the thickness of the stiffener material itself.

These imperfections near the edge can be in the form of edge notches, waviness (in-plane or out-of-plane), local thickness variations, local residual stress variations, or variations in material yield strength. Where multiple imperfections occur together, they may all compound together to further increase the stress concentration effect, and thus lower the wind load level at which failure is initiated. Thus, the existence of any edge imperfections in a conventional stiffener has the effect of enhancing an already established process of failure initiation.

Second, all the above conventional stiffeners, when manufactured out of relatively thin sheet metal are more susceptible to buckling due to the reduced thickness. Buckling is an instability in a part of the stiffener associated with local compressive or shear stresses. Buckling can precipitate section failure of the stiffener. This in turn causes a stress concentration in the adjacent door skin near the buckled stiffener section which causes the door to fail.

Finally, some thinner conventional stiffeners can experience "rolling" when placed under load. Rolling is when the shear stresses within the stiffener result in a net torque about the centroid of the thin walled cross-section thus causing the cross-section to twist possibly making the stiffener unstable. Another cause of rolling is the curvature of the door itself under wind load that is imposed upon the stiffener. Manufacturers have increased the cross-sectional length of the flange furthest from the door of the conventional C-channel stiffener trying to solve the rolling problem but were met with only marginal improvement. This is because the increased flange length had the simultaneous effect of increasing the distance from the centroid to the shear center of the channel. Additionally, increasing the cross-sectional flange length caused difficulty in accessing the fasteners used in mounting the C-channel to the door.

Because of the higher wind load requirements of local building codes and the problem of the fastening of relatively thick sections to sections relatively less thick, there is a need within the industry today for a new stiffener configuration that can address all of the above mentioned drawbacks and short comings of the present state of the art, is suitable for use with substantially all standardized overhead doors, and can be made on a cost effective basis.

SUMMARY OF THE INVENTION

The present invention alleviates and overcomes the above mentioned problems and shortcomings of the present state of the art through a novel overhead door stiffener. The novelty and uniqueness of this invention is that it 1) is made of thinner material to reduce the in-plane stresses found in the fastener area, 2) resists deflection adequately to meet new higher building code requirements, 3) is resistant to buckling and rolling, 4) effectively addresses edge stress concentrations by modifying the blade edge to an area of relatively low stress, and 5) can be manufactured cost effectively by using conventional manufacturing methods.

This novel invention may be described as a substantially reconfigured or stabilized J-stiffener having a mounting flange. It should be noted here that due to their extreme susceptibility to rolling, conventional J-stiffeners are seldom used in overhead garage doors. The unexpectedly strong synergisms of the unique characteristics found in the stabilized J-stiffener not only address the above problems, but simultaneously obtain material savings. More particularly the synergisms may be described as follows.

The instant invention has substantially redistributed material at critical locations as compared with conventional stiffener configurations. This material redistribution has the effect of altering considerably the behavior of the stiffener as compared with conventional J-stiffeners and other stiffener configurations. The material redistribution required to accomplish these collaborative effects is accomplished by having specifically placed free edge portions, which are turned inwardly to define tubular beads or curls along the free edges. Moreover it is not just the presence of the tubular bead or curl that enables the substantial level of synergism, but the discovery of specific ratios of curl diameter to other stiffener dimensions that maximize these synergisms even to the extent of obtaining significant weight savings.

Two sets of synergisms combine to make the present invention successful. The first set of synergisms is directly related to the ratio of the diameter of the curl to the stiffener section flange length and web length. Each tubular bead has a cross-sectional dimension which when combined in specific ratios with other stiffener dimensions substantially maximizes the moment of inertia of the overall section about the horizontal and vertical axes with a minimal use of material. Moreover, the tubular bead size specified by these same ratios has the effect of altering the characteristic failure mode normally associated with the free edge stress concentration for conventional stiffeners as described above. Finally, the cross-sectional dimension of the tubular beads of the stabilized J-stiffener make the novel stiffener less sensitive to edge imperfections and damage because the blade edge has now been placed in a position of relatively benign stress levels so that imperfections or damage to the tube or edge region have to be on the order of size of the diameter of the curl in order to have significant detrimental effect to the stiffener section.

Having established the above ratios, a second set of synergisms was discovered by directly combining the above with specific ratios of the stiffener's cross-sectional web dimension to cross-sectional flange dimension. The compounding effect of the first set of synergisms with this additional set of ratios makes the stabilized J-stiffener more resistant to rolling and buckling and thus avoids the problems that plague deeper conventional overhead door stiffeners using thinner gauge material. Additionally these compounding synergisms make this stiffener unique in that stresses are now more evenly distributed in the flanges thus making the stiffener more stable and less sensitive to dimensional imperfections. Because of these cooperative effects, the stabilized J-stiffener demonstrates its uniqueness and efficiency in using thinner gauge material to reduce inplane stresses found in the fastener area allowing the door and stiffener to work together as a cohesive system instead of as individual components.

Because the stabilized J-stiffener effectively addresses the problem of in-plane stresses at the area nearest the door panel, sheet metal screws traditionally used throughout the industry can once again be used without resorting to clips. Thus, the installer may now uniquely rely upon a single stiffener design to address the stiffening of a wide variety of door constructions.

When compared to conventional stiffeners on the market today, the stabilized J-stiffener uses substantially thinner material while obtaining better resistance to wind load. Thus even though additional slit width (width of the sheet of material from which the stiffener is made) is required to reposition needed material, the use of thinner gauge material more than offsets the additional slit width, bringing overall material savings as high as 30% in many instances. This innovation in system configuration also represents a substantial cost savings for the manufacturer, since material cost is a substantial portion of total manufacturing costs for overhead door hardware. Thus, this unique and novel stiffener is very cost effective.

For manufacturing process cost efficiency, the tubular bead is preferably an open-section bead, meaning that the sheet metal is formed in an almost complete bend or curl, but the curl need not be closed at its outer edge, such as by welding. A closed section tubular bead would work equally well, at a slightly higher manufacturing cost.

This edge feature is discussed in more detail in the following paragraph. The fastener section curl and the trough curl are tubular features, preferably open-sections, that are made by shaping the free edges or edge marginal portions of the stiffener cross-sections into an elliptical, preferably circular, cross-sectional shape. As used herein, a circular cross-section is considered to be a special case of an elliptical cross-section. The term "characteristic diameter" refers to a constant diameter in the case of a circle, while other elliptical shapes will have major and minor axes or diameters, with the major axis or diameter being the "characteristic diameter". Even though some configurations of a slightly non-circular elliptical shape may be more desirable in some applications, the circular cross-section is generally preferable, because it is simpler to manufacture, while still achieving the desired benefits to a significant degree.

It is important to contrast the edge curl approach against other possible edge treatment approaches by noting that the dimensional order of size effect related to imperfections or damages described above for the curl can not be achieved by simply folding the edge over, either once or multiple times, because in this case the characteristic dimension will be defined by the fold edge diameter and not by the length of overlap of the fold. This is because the overlap direction is transverse to the edge and quickly moves out of the peak stress region, and because the edge fold diameter defines the maximum distance over which the edge stresses may be effectively spread.

The elliptical or circular open-section tubular shape or "edge curl" is contrasted to tubular sections of rectangular cross-sectional shapes, including folded edges, and to open-section tubular shapes of softened corner rectangular cross-sectional shapes in that the characteristic diameter will be defined in each of these other cases by the fold diameter or by the softened corner diameter nearest to the stiffener edge, as opposed to the overall diameter of the edge curl section. It may be noted that in this context a rectangular cross-section with very softened corners is in effect an imperfect ellipse or circle. In some instances, quasi-elliptical or quasi-circular cross-sections, imperfect ellipses, and imperfect circles, in the form of rectangular cross-sections with very softened comers may function adequately, but may also be more difficult to manufacture and will be less effective than a generally circular curl.

The resulting synergistic effect of the stabilized J-stiffener's material efficiency in obtaining the desired bending moment of inertia, the alteration of the characteristic failure mode, the reduction in sensitivity to edge imperfections and damage, resistance to buckling and rolling as well as the ability to spread stresses more uniformly has the same degree of compounding advantage as the conventional stiffener's compounding disadvantage of low resistance to buckling and rolling combined with sensitivity to relatively small edge or dimensional imperfections. Accordingly, it can now be appreciated by those versed in this art, that the novel stabilized J-stiffener of the instant invention provides a solution to the problems that the sectional overhead door art that has sought to overcome the shortcomings associated with conventional stiffener configurations available hitherto. In summary, the stabilized J-stiffeners of the present invention having inner mounting flanges are uniquely designed to be compatible with substantially all standard sectional overhead doors, thereby significantly reducing the number of stiffeners that manufacturers must carry in their inventories and package, to permit more stringent wind load code requirements to be met, and to permit this to be done without major modification of other door hardware such as end stiles.

The following description of the present invention may incorporate dimensions which are representative of the dimensions which will be appropriate for most commonly found overhead door sizes. Recitation of these dimensions is not intended to be limiting, except to the extent that the dimensions reflect relative ratios between the sizes of various elements of the invention, as will be explained where appropriate.

BRIEF DESCRIPTION OF THE DRAWINGS

FIG. 5 is an enlarged section of the stiffener removed from the door section;

FIG. 6 is an enlarged sectional view of a bead on a free end of the stiffener; and FIG. 7 is an enlarged section of a modified stiffener in which the mounting flange extends in an opposite direction from the mounting flange for the embodiment of FIGS. 1–6.

DESCRIPTION OF THE INVENTION

Figure 2:
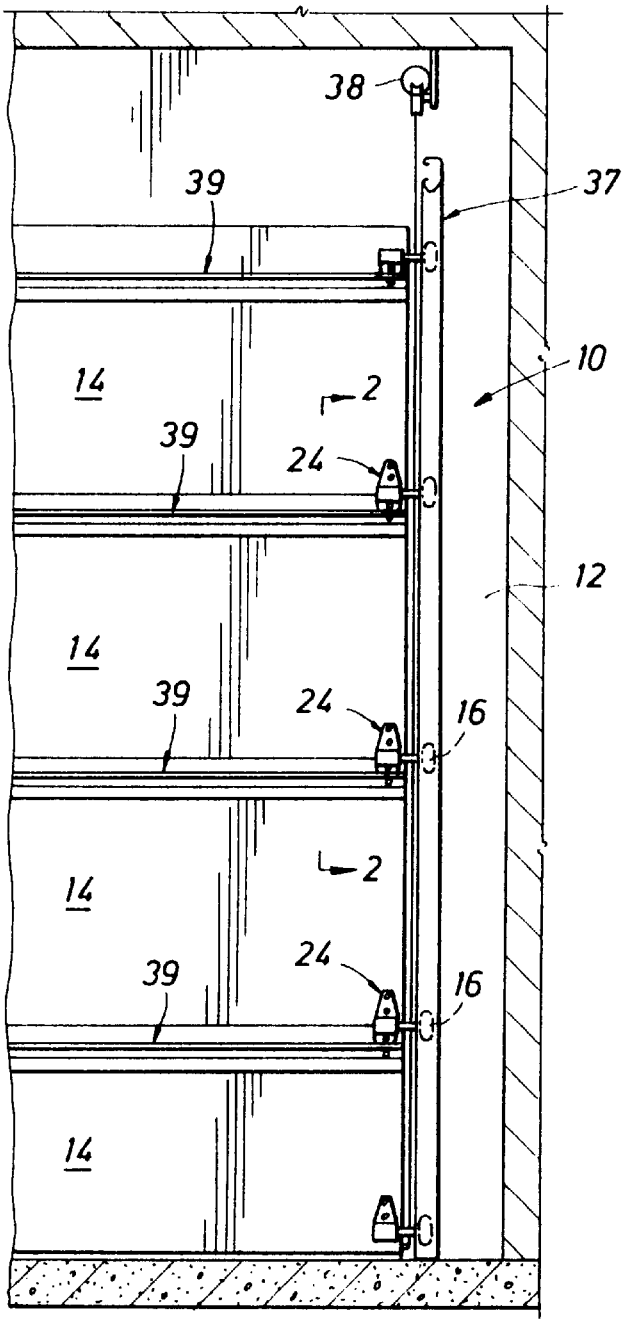
FIG. 2 is a side elevation of a portion of the sectional overhead garage door shown in FIG. 1 showing a pair of adjacent door sections hinged to each other and having a horizontally extending stiffener with a mounting flange secured to each door section.
Figure 1:
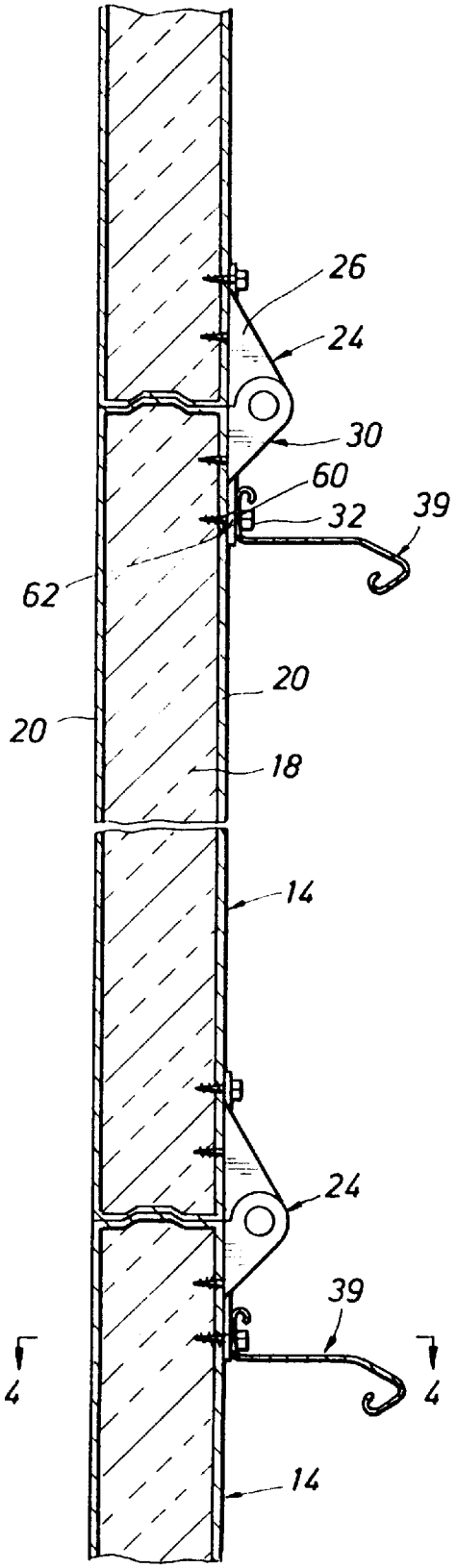
FIG. 1 is a perspective of the inner side of a hinged sectional overhead garage door having rollers mounted in a track for movement of the door between open and closed positions with stabilized J-stiffeners of the present invention having mounting flanges mounted on the hinged door sections.

Referring now to the drawings for a better understanding of this invention, and more particularly to the preferred embodiment shown in FIGS. 1–6, an overhead garage door is shown generally at 10 for fitting against a door jamb or frame 12 in closed position. Door 10 includes a plurality of hinged sections or panels 14 having rollers 16 mounted thereon. Each hinged section 14 comprises an inner foam base 18 having outer metal liners or sheaths 20 on opposed sides thereof thereby to form an insulated door section. A hinge 24 is supported on adjacent sections 14. As shown particularly in FIG. 3, a typical hinge generally indicated at 24 has an upper hinge section 26 secured to an upper door section 14 by fasteners 28 and a lower hinge section 30 secured by fasteners 31 and 32 to lower door section 14. Fasteners 28, 31 and 32 comprise sheet metal screws. Lower hinge section 30 has a sleeve 34 receiving a shaft 36 of roller 16. Hinges 24 are normally mounted at opposite ends of the associated hinge sections. However, additional hinges 24 between door sections may be provided, if desired, between the ends of the hinged door sections, particularly if the garage door is over 9 feet in width.

In addition, where desired the stiffener may use standard brackets such as an L-bracket as an additional means of attaching the stiffener to the door.

A track supports overhead door 10 for movement between open and closed positions includes a pair of parallel tracks 37 on the door frame 12 along opposite sides of door 10. Rollers 16 on opposed sides of door 10 are guided and supported in tracks 37 for movement of door 10 between a closed position and an open overhead position. Suitable counterbalancing helical springs 38 anchored at one end are operatively connected by a pulley and cable arrangement to door 10 for assisting in the manual opening of door 10 as is well known. If desired, a suitable motor may be provided for opening and closing of door 10.

To reinforce and stiffen sectional door 10, particularly against wind loads, each hinged door section or panel 14 has a stiffener generally indicated at 39 mounted thereon and extending between opposite sides of the associated door section 14. Stiffener 39 is generally of a J-shaped configuration with a mounting flange. As shown in the drawings, stiffener 39 commonly formed of a sheet metal material such as a steel alloy, comprises in the closed position of door 10 a horizontal body 40, an integral vertical mounting flange 41 at right angles to body 40, and an integral outer bowed flange 42. The opposed free edge portions of mounting flange 41 and bowed flange 42 are downturmed inwardly to form open-section tubular beads or edge curls 44 and 46. An open gap 48 is formed adjacent each tubular bead 44, 46. Tubular beads 44, 46 are shown as being of circular configurations or shapes in cross section and have outer diameters indicated at d and d1. Tubular beads 44, 46 are downturned inwardly an angular amount A of about 270 degrees from the flange 41 and bowed flange 42 as shown in FIGS. 5 and 6 particularly. Thus, gap 48 is of an angular amount about 90 degrees. If desired, tubular beads 44, 46 could be closed although 270 degrees has been found to be optimum. An angular or circular shape for beads 44, 46 as small as about 210 degrees would function in a satisfactory manner in most instances.

While a circular shape for tubular beads 44 and 46 is preferred, a generally elliptical shape would function adequately in most instances. A tubular bead or curl of an elliptical 20 shape has a major axis and a minor axis. Diameter or dimension d or d1 for an elliptical shape is interpreted herein for all purposes as the average dimension between the major axis and the minor axis. The major and minor axes are at right angles to each other and defined as the major and minor dimensions of the open or closed tubular section. To provide an effective elliptical shape for tubular beads 44 and 46, the length of the minor axis should be at least about 60 percent of the length of the major axis. The terms "elliptical" shape and "elliptical" cross section are to be interpreted herein for all purposes as including circular shapes and circular cross sections. Preferably, diameter d1 for bead 46 is larger than diameter d for bead 44. Bowed flange 42 is generally bowl shaped and has an outwardly sloping wall portion 50 extending downwardly from horizontal body 40 to an arcuate apex 52. An integral inwardly and downwardly sloping wall portion 54 extends from arcuate apex 52 to bead 46.

In order for tubular beads 44, 46 to provide maximum strength with a minimal cross sectional area of stiffener 39, the diameter d1 of tubular bead 46 is selected according to the width W1 of bowed flange 42 as shown in FIG. 5.

A ratio of about 5 to 1 between W1 and d has been found to provide optimum results. A ratio of W1 to d1 of between about 3 to 1 and 8 to 1 would provide satisfactory results. A similar ratio between W2 and d for tubular bead 44 is utilized. As an example of a suitable stiffener 39, W1 is 1 inch, W2 is 1 inch, and W3 is 3 ½ inches. The diameter d for bead 44 is 3/16 inch and diameter d1 for bead 46 is ¼ inch.

In order to obtain the desired minimal weight stiffener, tubular curls or beads 44, 46 must be shaped and formed within precise ranges and sizes in order to provide maximum strength. Using various design formulae to determine the outer diameters of tubular curls 44, 46, an optimum outer diameter of ¼ inch was found to be satisfactory. However, it is preferred that diameter d1 for curl 46 be slightly larger than diameter d for curl 44. W1 and W2 are between about three (3) and five (5) times the outer diameter of tubular curls 44 and 46 for best results. Width W3 is between about two (2) and five (5) times widths W1 and W2 for best results. By providing such a relationship between tubular curls 44, 46 and widths W1 and W2 the moment of inertia is maximized and edge stress concentrations are minimized for stiffener 39 thereby permitting the light weight construction for stiffener 39 of the present invention. Tubular curls 44, 46 are illustrated as turned inwardly which is the most desirable. In some instances it may be desirable to have a tubular curl turned outwardly.

Figure 3:
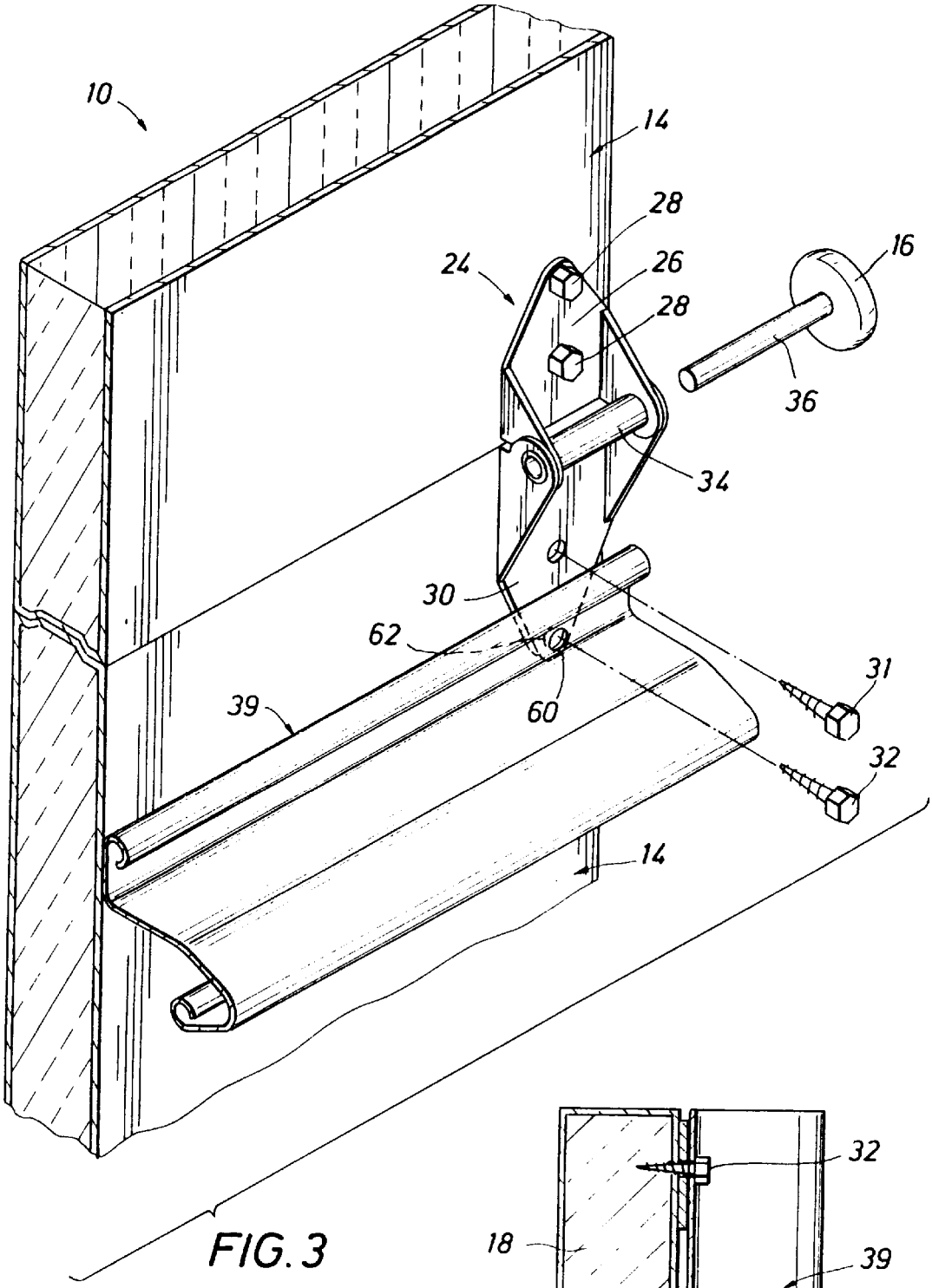
FIG. 3 is a perspective of the stabilized J-stiffener mounted on a hinge connecting a pair of hinged door sections.
Figure 4:
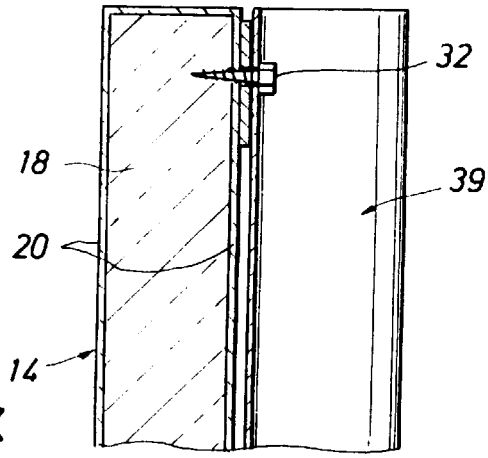
FIG. 4 is an enlarged sectional view taken generally along line 4—4 of FIG. 2 and showing a stiffener secured by fasteners to the inner side of an associated door section.

For mounting stiffener 39 on a door section 14 as shown particularly in FIGS. 2–4, mounting flange 41 has an opening 60 at each end thereof in axial alignment with opening 62 in subjacent hinge section 30 and metal fastener 32 secures flange 41 thereon to metal liner 20. Additional fasteners as desired may be added along the length of mounting flange 41 for mounting stiffener 39 on door section 14. While stiffener 39 has been shown as mounted adjacent the upper side of door section 14 stiffener 39 may, if desired, be mounted intermediate the width of door section 14. Stiffener 39 may be mounted on each door section 14, or only on selected door sections 14 as may be desired.

FIG. 7 shows another embodiment of a stiffener in which stiffener 39A has a mounting flange 41A extending from body 40A in the same direction as outer bowed flange 42A. Tubular curls or beads 44A and 46A together with the dimensions shown at W1, W2, W3, d, and d1 are similar to the embodiment of FIGS. 1–6. The only change in the embodiment of FIG. 7 from the embodiment of FIGS. 1–6 is the direction in which mounting flange 41A extends.

Overhead garage doors generally range between a nine (9) foot width for single cars and an eighteen (18) foot width for two cars. A typical nine (9) foot door weighs approximately one hundred and twenty (120) pounds and an eighteen (18) foot door weighs approximately two hundred and ninety (290) pounds when utilizing a door comprising foam filled sectional panels having a steel skin or sheath. A typical single car overhead door is seven (7) feet high and composed of four door sections or panels having a width of twenty one inches, each of which is nine (9) feet long.

A stiffener is preferably secured to each of the door sections having a thickness of 20 gauge (0.038 inch) with W1 and W2 being one inch and W3 being 3 ½ inches. Diameter d is 3/16 inch and diameter d1 is ¼ inch.

For a typical two hundred and ninety (290) lbs. double car overhead door, the dimensions noted above would be similar except the typical length of the door sections or panels are (18) feet long.

As a result of providing the inturned tubular beads or curls along the marginal edge portions of the stiffener, an unexpectedly significantly thinner gauge material generally about twenty five percent lighter has been utilized for the stiffener as compared with prior art door stiffeners as utilized heretofore. By utilizing precise tubular beads as set forth herein on the selected members where it is most needed for strength, a manufacturer may utilize an unexpectedly substantially thinner gauge material while eliminating or minimizing problems encountered heretofore by prior art designs of stiffeners for overhead sectional doors, such as used in garages and vehicles.

While the particular invention as herein shown and disclosed in detail is fully capable of obtaining the objects and providing the advantages hereinbefore stated, it is understood that this disclosure is merely illustrative of the presently preferred embodiments of the invention and that no limitations are intended other than as described in the appended claims.

What is claimed is:

1. In an overhead sectional door structure including a plurality of horizontally hinged door sections having rollers thereon mounted within a track for guiding said rollers and supporting said door sections for movement between open and closed positions;

a horizontally extending stiffener extending lengthwise across the width of the inner side of a door section; said stiffener with the door section in a closed position defining in cross section a generally horizontal body extending outwardly from said door section, an inner vertical mounting flange integral with said horizontal body in face to face contact with said door section, and an outer bowed flange integral with said horizontal body; said inner vertical mounting flange and said outer bowed flange each having a free edge;

a tubular bead extending along the free edge of said vertical mounted flange and said outer bowed flange, said tubular beads being inturned and of an elliptical cross section wherein the minor axis is at least 60 percent of the major axis; and fasteners extending through said inner vertical mounting flange and secured to said door section for mounting the stiffener onto said door section.

2. In an overhead sectional door structure as set forth in claim 1 wherein said inturned tubular beads are of a circular cross section and extend in a circular path of at least 225 degrees.

3. In an overhead sectional door structure as set forth in claim 2 wherein said inturned tubular beads extend in a circular path of at least 270 degrees.

4. In an overhead sectional door structure as set forth in claim 1 wherein said outer bowed flange extends downwardly from said horizontal body and forms a trough facing said door section, said horizontal body having a width at least two times the width of said outer bowed flange and the width of said inner vertical mounting flange.

5. In an overhead sectional door structure as set forth in claim 1 wherein the width of said bowed flange and said inner vertical mounting flange is at least two times the outer diameter of said associated beads.

6. In an overhead sectional door structure as set forth in claim 5 wherein said horizontal body has a width between two times and seven times the width of said bowed flange and the width of said inner vertical mounting flange.

7. In an overhead sectional door structure as set forth in claim 1 having hinges between adjacent door sections; said stiffener extending over at least a portion of the hinges on an associated door section, and said fasteners adjacent the ends of said stiffener extend through the associated hinges for securement to said door section.

8. A stiffener for a door section of a sectional overhead garage door extending lengthwise between opposite sides of the door section and secured to the door section; said stiffener comprising:

a generally horizontal body extending outwardly from said door section, an inner vertical mounting flange integral with said horizontal body arranged for face to face contact with said door section, and an outer bowed flange integral with said horizontal body; said vertical mounting flange and said bowed flange each having a free edge;

tubular bead extending along the free edge of said vertical mounting flange and said bowed flange, said tubular beads being of an elliptical cross section wherein the minor axis is at least about 60 percent of the major axis; and fasteners extending through said inner vertical mounting flange for mounting the stiffener onto said door section.

9. A stiffener for a door section of a sectional overhead garage door as set forth in claim 8 wherein said inturned tubular beads extend in a circular path of at least 270 degrees.

10. A stiffener for a door section of a sectional overhead garage door as set forth in claim 8 wherein said outer bowed flange extends downwardly from said horizontal body and forms a trough facing said door section, said horizontal body having a width at least two times the width of said outer bowed flange and the width of said inner vertical mounting flange.

11. A stiffener for a door section of a sectional overhead garage door as set forth in claim 8 wherein the width of said bowed flange and said inner vertical mounting flange is at least two times the outer diameter of said associated beads.

12. A stiffener for a door section of a sectional overhead garage door as set forth in claim 8 wherein said horizontal body has a width between two times and seven times the width of said bowed flange and the width of said inner vertical mounting flange.

13. A sectional overhead garage door comprising:

a pair of parallel tracks fixed to a supporting frame for the door;

a plurality of door sections having hinges mounted between adjacent door sections and extending between said tracks;

rollers supported on said hinges and received within said tracks for supporting and guiding said door sections between open and closed positions;

a stiffener for at least one of said door sections, said stiffener including a generally horizontal body extending outwardly from said door section, an inner vertical mounting flange integral with said horizontal body arranged for face to face contact with said door section, and an outer bowed flange integral with said horizontal body; said vertical mounting flange and said bowed flange each having a free edge;

a tubular bead extending along the free edge of said vertical mounting flange and said bowed flange, said tubular beads being inturned and of an elliptical cross section wherein the minor axis is at least about 60 percent of the major axis; and fasteners extending through said inner vertical mounting flange for mounting the stiffener onto said door section.

14. A sectional overhead garage door as set forth in claim 13 wherein said outer bowed flange extends downwardly from said horizontal body and forms a trough facing said door section, said horizontal body having a width at least two times the width of said outer bowed flange and the width of said inner vertical mounting flange.

15. A sectional overhead garage door as set forth in claim 13 wherein the width of said bowed flange and said inner vertical mounting flange is at least two times the outer diameter of said associated beads.

16. A sectional overhead garage door as set forth in claim 13 wherein said horizontal body has a width between two times and seven times the width of said bowed flange and the width of said inner vertical mounting flange.

17. A stiffener for a door section of a sectional overhead garage door extending lengthwise between opposite sides of the door section and secured to the door section; said stiffener comprising:

a generally horizontal body extending outwardly from said door section, an inner vertical mounting flange integral with said horizontal body arranged for face to face contact with said door section, and an outer bowed flange integral with said horizontal body; said vertical mounting flange and said bowed flange each having a free edge;

a tubular bead extending along the free edge of said vertical mounting flange and said bowed flange, said tubular beads being of a circular cross section and extending in a circular path of at least 225 degrees; and fasteners extending through said inner vertical mounting flange for mounting the stiffener onto said door section.

* * * * *